US005153499A

United States Patent [19]

Klesh

[11] Patent Number: 5,153,499

[45] Date of Patent: Oct. 6, 1992

[54] PRECISION VOLTAGE CONTROLLED CURRENT SOURCE WITH VARIABLE COMPLIANCE

[75] Inventor: Joseph J. Klesh, Hudson, N.J.

[73] Assignee: Allied-Signal Inc., Morris Township, Morris County, N.J.

[21] Appl. No.: 762,669

[22] Filed: Sep. 18, 1991

[51] Int. Cl.[5] ..... G05F 3/08

[52] U.S. Cl. ..... 323/280; 323/312; 330/105; 330/260

[58] Field of Search ..... 323/268, 269, 270, 280, 323/281, 297, 311, 312, 353, 354; 307/296.6; 330/84, 85, 105, 252, 260

[56] References Cited

U.S. PATENT DOCUMENTS

| | | | |
|---|---|---|---|
| 3,225,292 | 12/1965 | Miura | 323/89 |
| 3,375,435 | 3/1968 | Baugher | 323/280 |
| 4,110,677 | 8/1978 | Boronkay et al. | 323/19 |
| 4,302,726 | 11/1981 | Shobbrook | 330/260 |
| 4,427,935 | 1/1984 | Bowden | 323/280 |
| 4,451,779 | 5/1984 | Griep | 323/312 |
| 4,546,318 | 10/1985 | Bowden | 323/280 |
| 4,651,083 | 3/1987 | Lachmann et al. | 323/316 |
| 4,680,535 | 7/1987 | Talmor | 323/312 |
| 4,706,013 | 11/1987 | Kuo | 323/316 |
| 4,885,477 | 12/1989 | Bird et al. | 307/296.8 |
| 4,933,625 | 6/1990 | Hayakawa | 323/280 |
| 4,940,930 | 7/1990 | Detweiler | 323/280 |
| 4,990,845 | 2/1991 | Gord | 323/312 |

OTHER PUBLICATIONS

Guy, John; "Build a Precise, Low-Current Source"; Electronic Design; pp. 105-106; Aug. 9, 1990; Cleveland, Ohio.

Henry, Tim; "Analysis and Design of the Op Amp Current Source"; Motorola Publication AN587; pp. 1-7; 1973; Phoenix, Ariz.

Graeme, Jerald; "Op Amps Turn Voltage References Into Current Sources"; EDN; pp. 191-198; Apr. 26, 1990; Newton, Mass.

Graeme, Jerald; "In Current Sources, Two Amplifiers Can Be Better Than One"; EDN; pp. 201-206; Apr. 26, 1990; Newton, Mass.

Graeme, Jerald; "Straightforward Design Adapts Current Sources To Digital Control"; EDN; pp. 107-114; May 10, 1990; Newton, Mass.

*Primary Examiner*—Peter S. Wong

*Attorney, Agent, or Firm*—C. N. Malvone; H. G. Massung; R. A. Walsh

[57] ABSTRACT

A voltage controlled current source with variable compliance produces a load current through a load impedance where the load current value is substantially independent of the value chosen for the load impedance. The value of the current is substantially proportional to the difference between a first and second input voltage, and is substantially inversely proportional to a value of resistance chosen as a sense resistance. The current source comprises two variable gain instrumentation amplifiers and a resistance means connected in series with the load impedance.

11 Claims, 3 Drawing Sheets

PRECISION VOLTAGE CONTROLLED CURRENT SOURCE WITH VARIABLE COMPLIANCE

BACKGROUND OF THE INVENTION

1. Field of the Invention

The present invention relates to electrical circuits for providing a current through a load impedance where the value of that current is a function of an input voltage and is substantially independent of the value of the load impedance.

2. Description of the Related Art

Several types of current sources have been designed in the past. One type of current source is known as a "Holland" current source. The disadvantage of a Holland current source is that it requires precision resistors that track each other over temperature. Motorola publication AN587 "Analysis And Design Of The Operational Amplifier Current Source", 1973, pp 1-7, provides a detailed analysis of this type of current source. FIG. 1 shows the schematic for a Holland current source. For this type current source, the output impedance is given by equation 1.

$$Z_0 = \frac{R3}{\frac{R3}{R4} - \frac{R2}{R1}} \qquad \text{EQ1}$$

Since the output impedance of a current source should be infinite, this equation illustrates that the ratio of R3 to R4 must be matched to the ratio of R2 to R1. It is this matching that requires the precision resistors to track each other over temperature. Since it is very difficult to maintain this match, the output impedance of this current source is reduced which results in the output current beginning to vary as a function of the load impedance.

Another type of current source uses a floating reference and a grounded load. An example of this type of current source can be found in EDN article "Op Amps Turn Voltage References Into Current Sources", Apr. 26, 1990, Pages 191 to 198. FIG. 2 illustrates one of the circuits discussed in this article. In this circuit, the floating reference is the zener diode. As can be seen in the Figure, the reference and current source are grounded through the load impedance.

JFET 10 biases zener diode 12 to establish a reference voltage Vr between inverting operational amplifier terminal 14 and operational amplifier output 16. As a result, the reference voltage also appears between noninverting operational amplifier terminal 18 and output terminal 16. This results in the reference voltage appearing across resistor 20. Since the polarity of the reference voltage is such that operational amplifier terminal 18 is more positive than operational amplifier terminal 16, this circuit will act as a current sink, and sink a current which is substantially equal to the value of the reference voltage divided by the value of resistor 20.

The floating reference current source has the disadvantage of using a zener diode which is sensitive to temperature variations. It should also be noted that this circuit has the added disadvantage of only being able to sink a current; if it is desirable to have this circuit act as a current source, the JFET and zener diode should be reversed. Yet another disadvantage is that changing the compliance or voltage available to the load, requires changing the supply voltage.

SUMMARY OF THE INVENTION

The present invention is a voltage controlled current source having an instrumentation amplifier, a high input impedance amplifier and a resistor. The instrumentation amplifier has a first input and a second input, a reference input and an output. The instrumentation amplifier first input receives the input voltage which controls the amount of current provided through a load impedance. The reference input of the instrumentation amplifier receives a load voltage which is produced by the current flowing through the load impedance. The high impedance amplifier has a first input, a second input and an output. The first input of the high impedance amplifier receives the output voltage from the instrumentation amplifier. The second input of the high input impedance amplifier receives the load voltage. The output of the high input impedance amplifier is connected to the second input of the instrumentation amplifier. A sense resistor is connected in series with the load impedance with both the sense resistor and load impedance connected between the output of the instrumentation amplifier and a reference voltage.

This circuit provides a current through a load impedance which is substantially proportional to the input voltage and is also substantially inversely proportional to the value of the sense resistor. The resulting load current is substantially independent of the value of the load impedance.

The present invention solves the problems associated with the Holland current source and the floating reference current source. The present invention does not require precision matching of resistors and it does not require a floating voltage reference to control the output current. In addition, the present invention offers the advantage of an adjustable compliance, and a current that can be set using a single or a differential input.

DESCRIPTION OF THE PREFERRED EMBODIMENT

Figure 1:
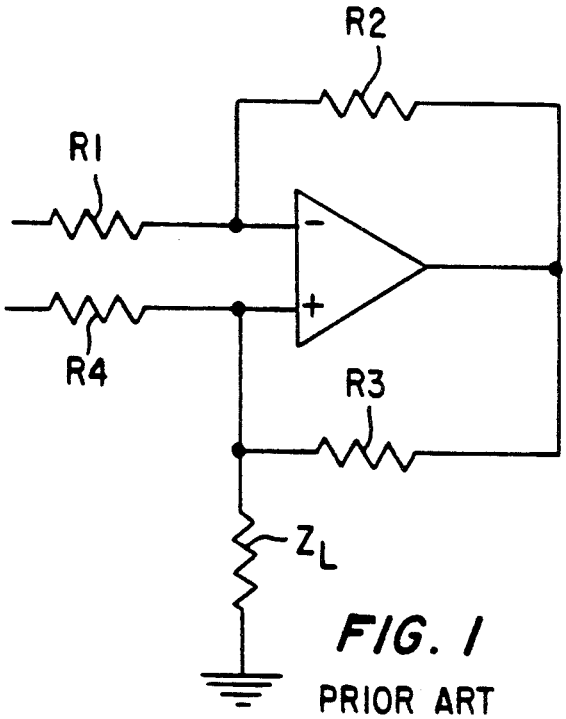
FIG. 1 PRIOR ART
FIG. 1 is a schematic diagram of a Holland current source.
Figure 2:
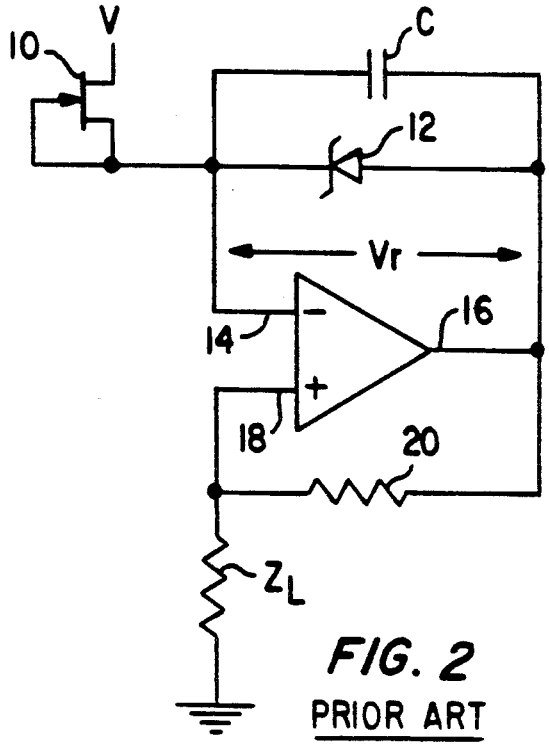
FIG. 2 PRIOR ART
FIG. 2 illustrates a current source with a floating reference and a grounded load.
Figure 3:
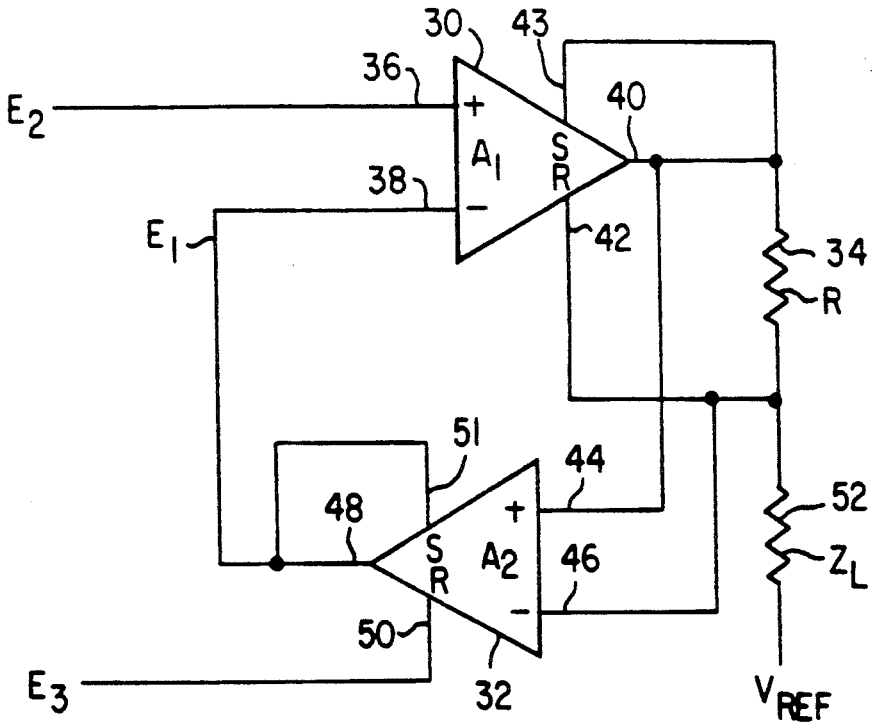
FIG. 3 is an embodiment of the present invention using two instrumentation amplifiers.

FIG. 3 is a schematic diagram of the present invention and it comprises instrumentation amplifier 30, instrumentation amplifier 32, and sense resistor 34. Instrumentation amplifiers 30 and 32 can have either a fixed gain or a variable gain. Instrumentation amplifier 30 comprises a noninverting input 36, inverting input 38, output 40, reference input 42 and sense input 43. Instrumentation amplifier 32 comprises noninverting input 44, inverting input 46, output 48, reference input 50 and sense input 51. Load impedance 52 is connected in series with sense resistor 34 between output 40 and a reference voltage. Reference input 42 of instrumentation amplifier 30 receives the load voltage which results from the current source's output current flowing through load impedance 52. Sense input 43 of instrumentation amplifier 30 receives the voltage at output 40. Noninverting input 44 of instrumentation amplifier 32 receives the voltage at output 40 of instrumentation amplifier 30. Inverting input 46 of instrumentation amplifier 32 receives the load voltage which results from the current passing through load impedance 52. Output 48 of instrumentation amplifier 32 is connected to inverting input 38 of instrumentation amplifier 30. Sense input 51 of instrumentation amplifier 32 receives the voltage at output 48. Input voltage $E_2$ is received by noninverting input 36 of instrumentation amplifier 30. Input voltage $E_3$ is received by reference input 50 of instrumentation amplifier 32. Input voltages $E_2$ and $E_3$ are taken with respect to the reference voltage.

The inputs to the amplifiers are high impedance inputs and therefore for the purposes of this analysis are considered to have a zero input current. Since the instrumentation amplifier inputs have an input current of nearly zero, nearly all of the output current produced by instrumentation amplifier 30, at output 40, flows through sense resistor 34 and load impedance 52. Output 40 of instrumentation 30 can either sink or source current.

The relationship between the inputs and output of instrumentation amplifier 30 is expressed by the following equation:

$$(E_2-E_1)A_1+V_x=V_0 \qquad \text{EQ2}$$

Where $E_2$ is the input voltage at noninverting input 36, $E_1$ is the voltage at inverting input 38, $A_1$ is the gain of instrumentation amplifier 30, $V_x$ is the voltage at reference input 42 and $V_0$ is the output voltage at output terminal 40. By observing that $V_x$ is equal to the voltage which results from the output current flowing through the load impedance, the following equation can be written.

$$V_x=V_0-I_0R \qquad \text{EQ3}$$

Where $I_0$ is the output current flowing through resistor 34 and output impedance 52, and where R is the value of sense resistor 34. By combining the last two equations the following equation results.

$$(E_2-E_1)A_1+V_0-I_0R=V_0 \qquad \text{EQ4}$$

By rearranging terms the following equation results.

$$I_0R=(E_2-E_1)A_1 \qquad \text{EQ5}$$

By using the same transfer function that was used in developing equation 2, the following expression for $E_1$ results.

$$E_1=[V_0-(V_0-I_0R)]A_2+E_3$$

$$E_1=I_0RA_2+E_3 \qquad \text{EQ6}$$

Where $A_2$ is the gain of instrumentation amplifier 32 and $E_3$ is the input voltage to reference input 50. By combining equations 5 and 6, the following equation results.

$$I_0=\frac{E_2-E_3}{R(A_1^{-1}+A_2)} \qquad \text{EQ7}$$

Equation 7 illustrates that the output current is proportional to the difference between input voltage $E_2$ and input voltage $E_3$ and that it is also inversely proportional to the value of sense resistor 34. It should also be noted that by setting input voltage $E_3$ equal to the reference voltage, the output current is proportional to input voltage $E_2$ rather than the difference between input voltage $E_2$ and input voltage $E_3$. It should also be noted that by setting the reference equal to ground, input voltages $E_2$ and $E_3$ will also be referenced with respect to ground.

The input voltages $E_2$ and $E_3$ can be controlled through the use of a digital to analog converter, switches obtaining voltages from a resistor network, or other convenient means to vary voltages $E_2$ and $E_3$.

It is preferable to use instrumentation amplifiers with programmable gains. By varying gains $A_1$ and $A_2$, the compliance of the current source can be varied. Referring back to equation 7, $I_0$ is a function of $E_2$ and $E_3$, and $I_0$ can be expressed by the following equation.

$$I_0=K'(E_2-E_3) \qquad \text{EQ8}$$

By rearranging terms the following equations result.

$$K=R(A_1^{-1}+A_2) \qquad \text{EQ9}$$

$$R=\frac{KA_1}{1+A_1A_2} \qquad \text{EQ10}$$

If $A_2$ is fixed and $A_1$ is allowed to increase from $0\rightarrow\infty$, R effectively varies from 0 to $K/A_2$. This results in an increase in the voltage drop across R and in effect reduces the compliance of the current source.

If $A_1$ is fixed and $A_2$ is allowed to increase from $0\rightarrow\infty$, R effectively varies from $K\,A_1$ to 0. This results in a decrease in the voltage drop across R and in effect increases the compliance of the current source.

Figure 4:
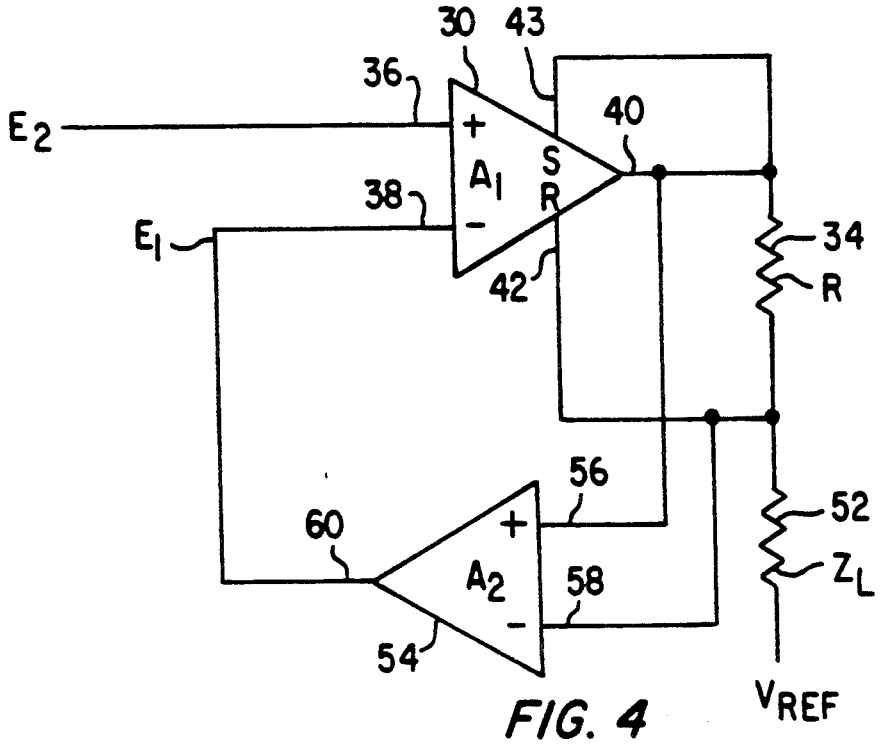
FIG. 4 is a schematic diagram of the present invention using a high input impedance amplifier.

FIG. 4 illustrates an embodiment of the present invention using high input impedance differential amplifier 54 rather than instrumentation amplifier 32. High input impedance amplifier 54 comprises noninverting input 56, inverting input 58 and output 60. In this embodiment, load impedance 52 is connected in series with sense resistor 34 between output 40 and a reference voltage. Reference input 42 of instrumentation amplifier 30 receives the load voltage which results from the current source's output current flowing through load impedance 52. Noninverting input 56 of high input impedance amplifier 54 receives the voltage at output 40 of instrumentation amplifier 30. Inverting input 58 of high input impedance amplifier 54 receives the load voltage which results from the output current passing through load impedance 52. Output 60 of high input impedance amplifier 54 is connected to inverting input 38 of instrumentation amplifier 30. Input voltage $E_2$ is received by noninverting input 36 of instrumentation amplifier 30. Input voltage $E_2$ is taken with respect to the reference voltage.

By performing an analysis which is similar to the analysis that was performed with respect to the circuit of FIG. 3, the following expression for the output current is obtained.

$$I_0 = \frac{E_2}{R(A_1^{-1} + A_2)} \quad \text{EQ11}$$

Figure 5:
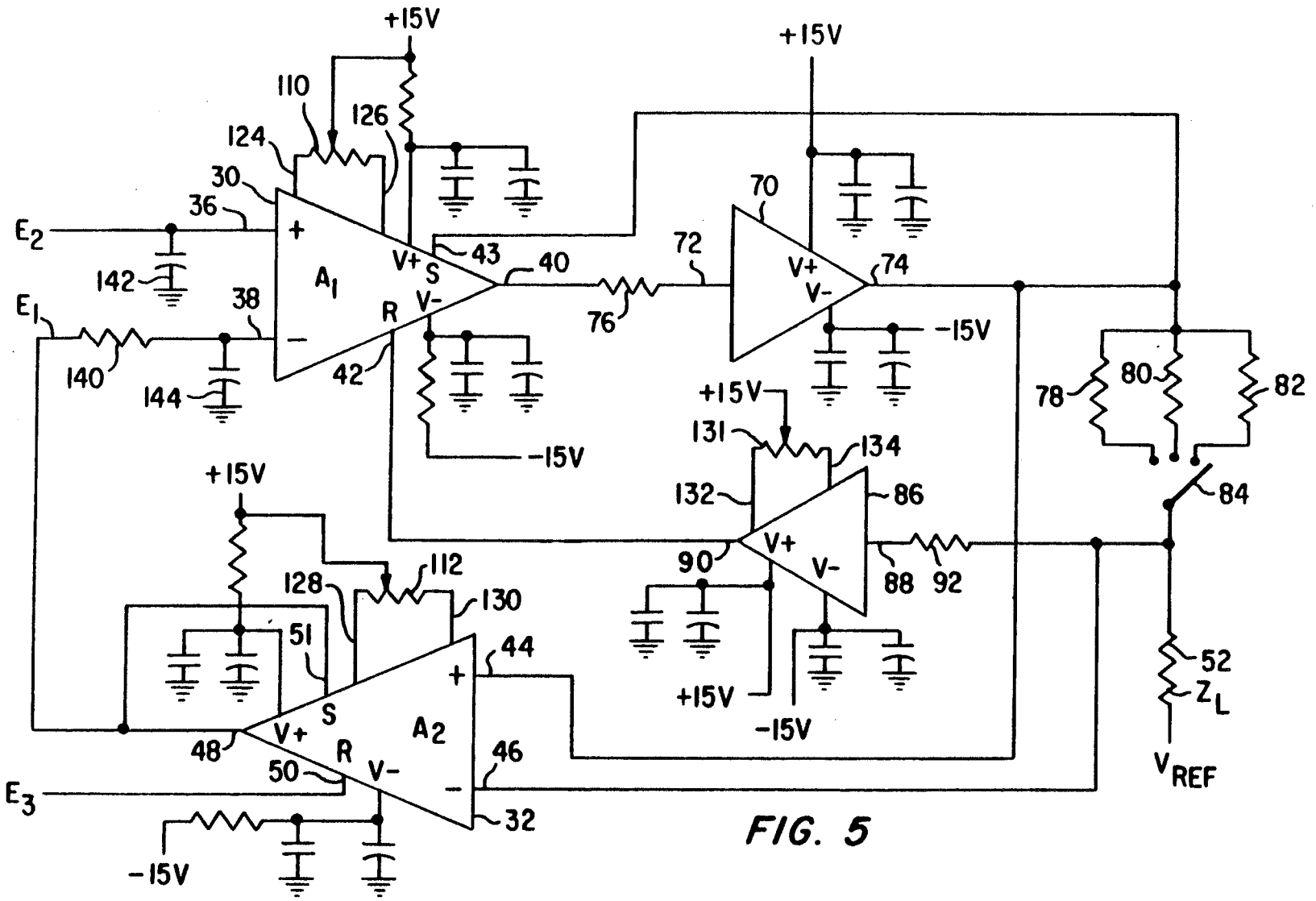
FIG. 5 illustrates an embodiment of the present invention using a current amplifier and a voltage follower.

FIG. 5 illustrates another embodiment of the present invention and shows the additional circuitry that is used to provide power supply decoupling and output nulling of the amplifiers. Where FIGS. 3 and 5 are similar, identical numbers have been used. To increase the amount of output current that can be provided by the present invention, current driver 70 with input 72 and output 74 has been added to the circuit. Current driver input 72 receives an input current from output 40 of instrumentation amplifier 30 through resistor 76. The preferred value for resistor 76 is 51.1 ohms. Output 74 of current driver 70 supplies the current through a sense resistor and load impedance 52. Sense input 43 of instrumentation amplifier 30 now receives the voltage at output 74 of current driver 70. Sense resistor 34 has now been replaced with a bank of resistors comprising resistors 78, 80 and 82. Any one of resistors 78, 80 and 82 can be connected in series with load impedance 52 through the use of multi position switch 84. Through the use of this resistor bank and switch 84, the value of the sense resistor, which is in series with the load impedance, can easily be varied and thereby provides an additional means for varying the output current. It is also possible to provide a switching arrangement which forms a sense resistance using a series or parallel arrangement of resistors. Other means, such as a potentiometer, can also be used to vary the sense resistance.

In order to isolate reference input 42 of instrumentation amplifier 30, from the current supplied to the load, voltage follower 86 with input terminal 88 and output terminal 90 has been added to the circuit. Voltage follower 86 receives the load voltage on input terminal 88 through resistor 92. The preferred value for resistor 92 is 10K ohms. Output terminal 90 of voltage follower 86 replicates the load voltage and provides it to reference input 42 of instrumentation amplifier 30. Voltage follower 86 has a high impedance input which minimizes the amount of output current used by reference input 42 of instrumentation amplifier 30. This improves the accuracy of the current source and is especially helpful at low current outputs.

In a preferred embodiment, the +15 v and −15 v power supply inputs of the current amplifier 70 and voltage follower 86 are each decoupled by a 22 microfarad electrolytic capacitor which is in parallel with a 0.1 microfarad ceramic capacitor. Each capacitor connects the power supply input to ground. Both power supply inputs of instrumentation amplifiers 30 and 32 are each decoupled through a series resistor having a preferred value of 20 ohms. Each power supply input is also decoupled by a 22 microfarad electrolytic capacitor and a 0.1 microfarad ceramic capacitor. The capacitors are arranged in parallel connecting the instrumentation amplifier side of the series resistor to ground.

The outputs of instrumentation amplifiers 30 and 32 are nulled using potentiometers 110 and 112, respectively. It is preferable that potentiometers 110 and 112 have a value of 10K ohms. Potentiometer 110 is connected between nulling inputs 124 and 126 for instrumentation amplifier 30, and potentiometer 112 is connected between nulling inputs 128 and 130 for instrumentation amplifier 32. The arm of each potentiometer is connected to the +15 v power supply.

Voltage follower 86 is nulled by placing potentiometer 131 between nulling inputs 132 and 134. The sweep arm of potentiometer 131 is connected to the positive power supply.

It is preferable to connect output 48 of instrumentation amplifier 32 to inverting input 38 of instrumentation amplifier 30 through resistor 140 having a preferred value of 1K ohm. It is also preferable to connect input 36 to ground through capacitor 142, and input 38 to ground through capacitor 144. Capacitors 142 and 144 are 0.1 microfarad ceramic capacitors. Resistor 140 and capacitor 144 are used to produce a dominent pole. This dominent pole improves the phase margin and therefore the stability of the current source. Capacitor 142 is used to minimize noise by filtering $E_2$.

Instrumentation amplifier AD524 manufactured by Analog Devices can be used as instrumentation amplifiers 30 and 32. Current driver LH002 manufactured by National Semiconductor can be used as current driver 70, and voltage follower LM110 manufactured by National Semiconductor can be used as voltage follower 86.

I claim:

1. A voltage controlled current source for producing a desired load current which flows through a selected load impedance, the load current being a function of a provided input voltage taken with respect to a provided reference voltage and being substantially independent of that impedance value chosen for the load impedance, the voltage controlled current source comprising:

(a) an instrumentation amplifier having a first input, a second input, a reference input and a first output, said first input receiving the input voltage, said reference input receiving a load voltage produced by the load current flowing through the load impedance;

(b) a high input impedance amplifier having a third input, a fourth input and a second output, said third input receiving an output voltage produced by said first output, said fourth input receiving said load voltage, said second output electrically connected to said second input; and (c) a resistance means for providing a resistance, said resistance means being connected in series with the load impedance between said first output and the reference voltage so that load current values are substantially proportional to the input voltage and are substantially inversely proportional to a value of resistance chosen for said resistance means.

2. The voltage controlled current source of claim 1, wherein said resistance means comprises a plurality of resistors and a switching means for selectively connecting one of said resistors in series with the load impedance.

3. The voltage controlled current source of claim 1, further comprising a current amplifier which receives current from said first output and which provides current to said resistance means and the load impedance.

4. The voltage controlled current source of claim 1, further comprising a voltage follower which receives said load voltage and which supplies a follower voltage to said reference input.

5. The voltage controlled current source of claim 1, wherein the reference voltage is ground.

6. A voltage controlled current source for producing a desired load current which flows through a selected load impedance, the load current being a function of a provided first and second input voltage taken with respect to a provided reference voltage and being substantially independent of that impedance value chosen for the load impedance, the voltage controlled current source comprising:

(a) a first instrumentation amplifier having a first input, a second input, a first reference input and a first output, said first input receiving the first input voltage, said first reference input receiving a load voltage produced by the load current flowing through the load impedance;

(b) a second instrumentation amplifier having a third input, a forth input, a second reference input and a second output, said third input receiving an output voltage produced by said first output, said forth input receiving said load voltage, said second reference input receiving the second input voltage, said second output electrically connected to said second input; and (c) a resistance means for providing a resistance, said resistance means being connected in series with the load impedance between said first output and the reference voltage so that load current values are substantially proportional to the difference between the first and second input voltages and are substantially inversely proportional to a value of resistance chosen for said resistance means.

7. The voltage controlled current source of claim 6, wherein said resistance means comprises a plurality of resistors and a switching means for selectively connecting one of said resistors in series with the load impedance.

8. The voltage controlled current source of claim 6, further comprising a current amplifier which receives current from said first output and which provides current to said resistance means and the load impedance.

9. The voltage controlled current source of claim 6, further comprising a voltage follower which receives said load voltage and which supplies a follower voltage to said first reference input.

10. The voltage controlled current source of claim 6, wherein the reference voltage is ground.

11. A voltage controlled current source for producing a desired load current which flows through a selected load impedance, the load current being a function of a provided first and second input voltage taken with respect to a provided reference voltage and being substantially independent of that impedance value chosen for the load impedance, the voltage controlled current source comprising:

(a) a first instrumentation amplifier having a first variable gain, a first input, a second input, a first reference input and a first output, said first input receiving the first input voltage, said first reference input receiving a load voltage produced by the load current flowing through the load impedance;

(b) a second instrumentation amplifier having a second variable gain, a third input, a forth input, a second reference input and a second output, said third input receiving an output voltage produced by said first output, said forth input receiving said load voltage, said second reference input receiving the second input voltage, said second output electrically connected to said second input; and (c) a resistance means for providing a resistance, said resistance means being connected in series with the load impedance between said first output and the reference voltage so that load current values are substantially represented by the equation $$I_0 = \frac{E_2 - E_3}{R(A_1^{-1} + A_2)}$$

where $I_0$ represents the load current, $E_2$ represents the first input voltage, $E_3$ represents the second input voltage, R represents a value of resistance chosen for said resistance means, $A_1$ represents said first variable gain and $A_2$ represents said second variable gain.

* * * * *